US006497626B1

(12) United States Patent
Sundberg

(10) Patent No.: US 6,497,626 B1
(45) Date of Patent: Dec. 24, 2002

(54) GOLF PUTTER

(75) Inventor: Leif Sundberg, Forshaga (SE)

(73) Assignee: Leif Sundberg Golf AB (SE)

( * ) Notice: Subject to any disclaimer, the term of this patent is extended or adjusted under 35 U.S.C. 154(b) by 0 days.

(21) Appl. No.: 09/674,861

(22) PCT Filed: Sep. 22, 1999

(86) PCT No.: PCT/SE99/01654

§ 371 (c)(1),
(2), (4) Date: Jan. 4, 2001

(87) PCT Pub. No.: WO00/18476

PCT Pub. Date: Apr. 6, 2000

(30) Foreign Application Priority Data

Sep. 25, 1998 (SE) ..... 9803275

(51) Int. Cl.[7] ..... A63B 53/02; A63B 53/06

(52) U.S. Cl. ..... 473/248; 473/248; 473/313; 473/314; 473/340

(58) Field of Search ..... 473/313, 314, 473/340, 341, 246, 247, 248, 251

(56) References Cited

U.S. PATENT DOCUMENTS 1,657,972 A * 1/1928 Rowe
2,478,468 A * 8/1949 Drake
4,173,343 A * 11/1979 Richilano
4,702,477 A 10/1987 Solomon
5,340,106 A * 8/1994 Ravaris
5,344,141 A 9/1994 Smith
5,494,282 A 2/1996 Pranio
5,662,532 A * 9/1997 Mizumura
5,709,613 A 1/1998 Sheraw ..... 473/248

* cited by examiner

*Primary Examiner*—Stephen Blau
(74) *Attorney, Agent, or Firm*—Michael D. Bednarek; Shaw Pittman LLP

(57) ABSTRACT

This invention relates to a putter, comprising a shaft (7), a putter head (1) with a hitting face (3) and means for attaching the putter head (1) to the shaft (7), said shaft (7) having an imaginary center line (8) positioned substantially coaxial within said shaft, said putter head (1) having a center of gravity (x), wherein that the shaft (7) and the head (1) are attached to each other in such a manner that a the point of intersecting of said center line (8) and a normal extending inwardly of said hitting faces (3) is positioned at a longer distance from said hitting face (3) than the centre of gravity (x), so as to form a minimum distance (L) between said center line (8) and said centre of gravity (x).

13 Claims, 2 Drawing Sheets

GOLF PUTTER

This invention relates to a golf putter and especially a new manner of attaching the putter head to the shaft.

PRIOR ART AND PROBLEMS

The put requires enormous accuracy. It is evident that the shape and design of the putter does have a major influence on the performance when putting.

Many different designs and shapes have been suggested in order to improve accuracy. Originally, a putter head had a blade shape with the shaft attached thereto at the heel part, a design which goes back to the nineteenth century. In the meantime many different designs and shapes have been tried, e.g. a semi-spherical shaped putter head, the use of balancing weights, attachment of the shaft at the toe part of the putter head, attachment of the shaft near the centre of gravity of the shaft, etc. None of these differing designs have revolutionised the golf sport, but the different designs are used in a large variety among the players.

In contrast to other strokes the movement of the putter is relatively slow. Accordingly the player can be assisted by a sight line on the putter head in order to obtain extra accuracy of the movement when striking the golf ball. However, known putters do not provide means for a sight line which comes near the feeling of accuracy as with a cue when playing pool.

Furthermore, many putters of today have an attachment of the shaft to the putter head which is totally balanced when keeping the hitting face of the putter head upwards. This means that there will be no momentum in the shaft when moving it in a direction that is perpendicular to the hitting face. Accordingly, the player will not notice any torque of the shaft during the movement of the putter head if the putter head is rotated during the striking movement. Consequently, the player does not sense by means of a force of torque of the shaft if the putter head is moved out of the extension of the sight line when putting.

Finally, it appears that none of the existing putters does give the player a distinct feed back when hitting the golf ball in an exactly accurate manner.

From U.S. Pat. No. 4,702,477 there is known a putter which at first sight might appear to eliminate some of the conventional disadvantages mentioned above. Accordingly, U.S. Pat. No. 4,702,477 presents a putter comprising a shaft, a putter head with a hitting face and means for attaching the putter head to the shaft, said shaft having an imaginary centre line positioned substantially coaxial within said shaft, and, wherein said means comprises an attachment device having at least one rod shaped part having an imaginary centre line, wherein said rod shaped part is attached to the putter head so as to have said imaginary centre line extending substantially perpendicular in relation to the hitting surface of the putter head. However, the rod shaped part as shown in U.S. Pat. No. 4,702,477 is merely intended for increasing the golfers peripheral vision in the direction of the desired path of golf ball travel by providing for a location of the golf ball which is closer to the golfers front foot than is normally the case. Accordingly, the rod shaped part of U.S. Pat. No. 4,702,477 is not intended for providing a sight line, but is positioned off-centred in relation to spot for hitting the golf ball. Nor does the attachment according to U.S. Pat. No. 4,702,477 indicate any distinctive torque to the player if the putter head is rotating during the striking movement. Finally, U.S. Pat. No. 4,702,477 does not provide any means for giving the player a distinct feed back when hitting the golf ball in an exactly accurate manner.

SOLUTION AND ADVANTAGES

It is the object of the invention to provide a putter which eliminates or at least minimises the disadvantages mentioned above. This is achieved by a putter, comprising a shaft, a putter head with a hitting face and means for attaching the putter head to the shaft, said shaft having an imaginary centre line positioned substantially coaxially within said shaft, said putter head having a centre of gravity, said means comprising an attachment device having at least one rod shaped part with an imaginary centre line, said rod shaped part being attached to the putter head so as to have said centre line extending substantially perpendicular in relation to the hitting surface of the putter head, characterised in that said rod shaped part extends all the way through said putter head to form a part of the hitting surface, and that said part of the rod which forms a part of the hitting surface is positioned within the hitting surface in such a manner that the rod shaped part forms an extended sight line for extra accuracy of the movement when hitting a golf ball with the putter head.

The above mentioned design provides a putter which can provide an extended and distinct sight line in order to facilitate a movement along a straight line of the putter head. The invention will give the player a similar feeling of accuracy as a pool player since he will actually have the possibility to see a rod shaped part move along the sight line giving a feeling of extra accuracy.

Accordingly the invention provides a new kind of a putter having the following advantages:

- improved and extended sight line;
- favourable feed back when hitting the ball accurately; and
- an attachment t hat may eliminate twisting of the shaft and the putter head during the stroke.

According to further aspects of the invention:

- said front part of the rod shaped part is positioned to intersect a vertical centre line of the hitting surface, preferably substantially centered in relation to said centre line;
- said attachment device is L-shaped and comprises a further rod shaped part, a neck portion, which preferably extends substantially coaxially with said centre line of said shaft;
- said putter head is arranged with a rearwardly extending protrusion, preferably forming an integral part thereof, for attachment of the shaft thereto;
- there is arranged a sight line on top of the putter head, extending at least a portion between the point of attachment of the shaft and the upper edge of the hitting surface;
- said imaginary centre line of the shaft and a normal of the hitting face forms an angle $\alpha$ which is less than 90° in a plane that is parallel to the centre line of the shaft and perpendicular to the hitting face;
- the angle $\alpha$ is such that the top end of the shaft is positioned substantially in the same plane as the hitting face;
- the putter head is pivotally adjustably attached to said rod, preferably by means of a screw which may be tightened in a threaded bore of the head;
- said imaginary centre line of the rod shaped part is positioned within a distance from the lower part of the putter head that is between 15 and 25 mm, preferably about 20 mm, and preferably in that the hitting face has a plane that opens up about 2–5° in relation to a vertical plane;

the shaft and the head are attached to each other in such a manner that a point of intersecting of said centre line and a normal extending inwardly of said hitting face is positioned at a longer distance from said hitting face than the centre of gravity x, so as to form a minimum distance L between said centre line and said centre of gravity x;

said minimum distance L exceeds 10 mm and is less than 100 mm, preferably exceeds 20 mm, and more preferred exceeds 30 mm, or even more preferred exceeds 40 mm;

said rod shaped part has a contrasting colour in relation to the upwardly facing surface (1C) of the rearwardly extending protrusion (1A).

BRIEF DESCRIPTION OF THE DRAWINGS

The foregoing objects and advantages of the invention, together with other objects and advantages which may be achieved by using the invention, will become more apparent upon reading the following detailed description of the invention in conjunction with the drawings. In the drawings.

DETAILED DESCRIPTION OF THE INVENTION

Figure 1:
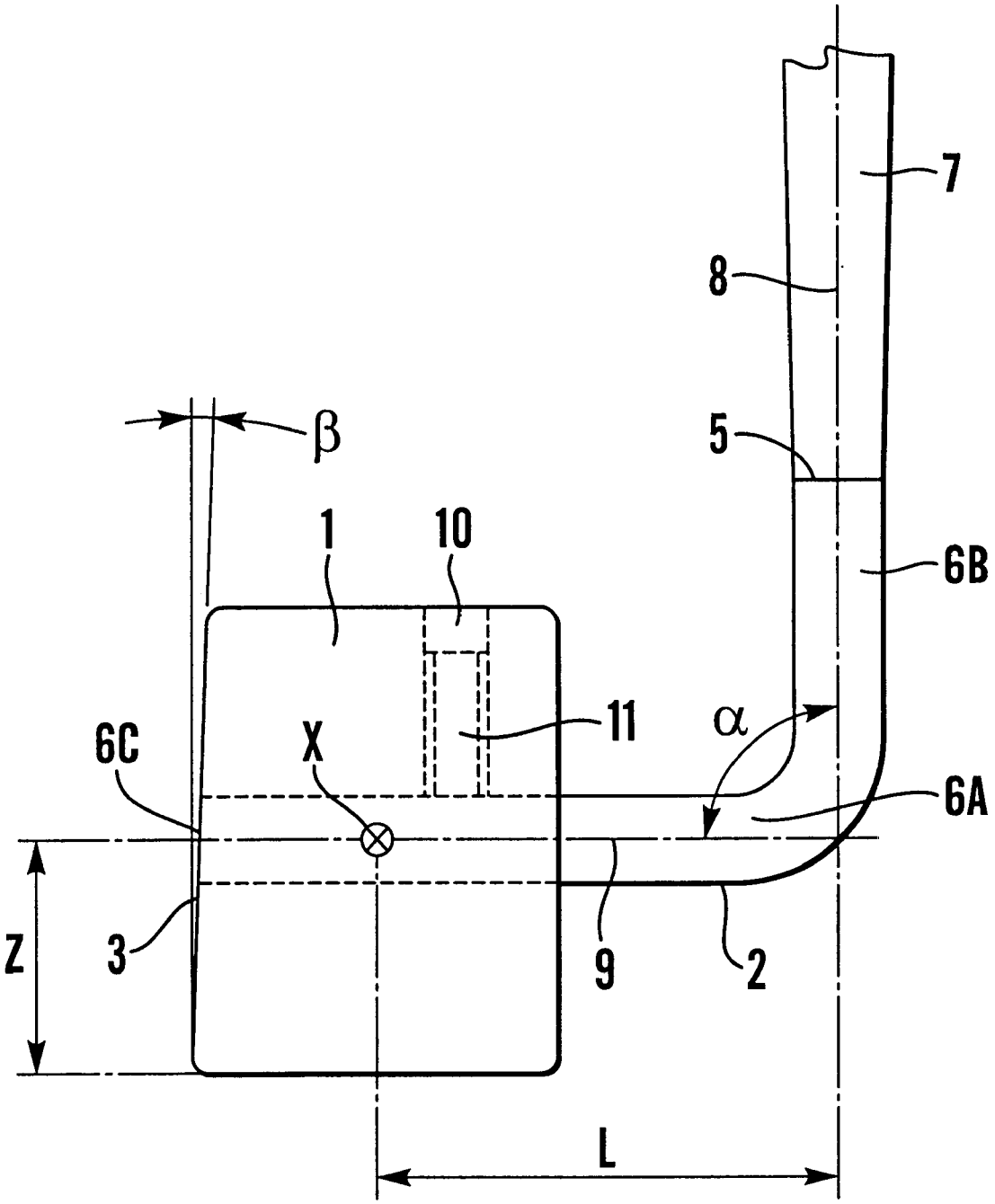
FIG. 1 is a side view of a putter illustrating the principles of the invention.

FIG. 1 shows a golf putter according to the invention, comprising a shaft 7 and a putter head 1 with a hitting surface 3. Between the shaft 7 and the putter head 1 there is an L-formed attachment means 2 for attaching said putter head to said shaft The shaft 7 has an imaginary centre line 8 positioned substantially coaxially within said shaft. The shaft has a circular cross-section which tapers downwards. The L-formed attachment means 2 comprises a horisontally extending rod shaped part 6A and vertically extending neck portion 6B. The shaft is connected to the upper end 5 of the vertically extending neck portion 6B, preferably by means of an adhesive. The putter head 1 is attached to the horisontally extending rod shaped part 6A by means of a threaded bore 10 within which a screw 11 is tightened against the rod 6A. The rod shaped part 6A protrudes through the centre of gravity x all the way through said putter head 1, such that the end surface 6C forming a part of the hitting face 3. The visual part of the horisontally extending rod shaped part 6A forms an extended sight line for extra accuracy of the movement when hitting a golf ball with the putter along a straight line. Furthermore, the top of the club head is arranged with a marked sight line (see 1B in FIG. 2), in a traditional manner.

The vertically extending neck portion 6B is coaxial with the centre axis 8 of the shaft 7. When the horisontally extending rod 6A is positioned exactly horisontally, the hitting face 3 will be positioned slightly out of the vertical plane, so as to form an open angle$\beta$, i.e. a loft of about 4° . Also the shaft is inclined with an angle $\alpha$ so that the top of the shaft, i.e. the handle, will be positioned in about the same plane as the hitting face 3.

The putter head has a centre of gravity x. The shaft 7 and the head 1 are attached to each other in such a manner that the imaginary centre line 8 of the shaft intersects the imaginary centre line 9 of the horisontally extending rod shaped part 6A at a distance L from said centre of gravity x. This distance, L, may vary depending on personal desires, weight of the putterhead etc, but its length must never exceed a certain limit since according to rules a head may not be deeper than wider. Normally the distance, L, would not exceed 8 cm, preferably it would be within the range of 3–7 cm. In the shown figure said distance L is about 5 cm. According to the design shown in FIG. 1 the imaginary line 9 of the horisontally extending rod shaped part 6A intersects the centre of gravity. Modifications are of course possible without loosing the advantages of the invention, e.g. the imaginary line of the horisontally extending rod shaped part 6A may be positioned higher up or further down but substantially within the same plane as the force vector of the centre of gravity x when the head is positioned with its bottom portion in a horizontal position, i.e. resting against the ground. Furthermore it may also be positioned slightly out of said plane. Moreover, it is not essential that the rod shaped part 6A is positioned exactly horisontally (as described above), since the player looks at it from above.

The distance indicated with z is the distance from the bottom border of the hitting face 3 to the point where the centre line 9 of the horisontally extending rod 6A intersects the hitting surface 3. This distance is about 20 mm.

According to a preferred embodiment the putter head 1 is symmetrical in relation to a vertical plane which comprises the centre line 3A of the hitting surface 3 and which is arranged perpendicularly in relation to the hitting surface 3. (See FIGS. 2 and 3). Furthermore the rod shaped part 6A extends through the centre line 3A (see FIG. 3) of such a symmetrical putter head, in such a manner that it intersects the centre of gravity and such that its front end 6C is positioned at the centre of said line of symmetry.

To get a good hit with the putter giving the ball the right mode of rotation the point 6C of the hitting surface 3 should strike the golf ball slightly below its centre point. The angle $\beta$ of inclination of the face 3 is also important for the strike and has an influence on the rotation mode of the ball.

During use, a putter according to the design of the invention will create a torque of the shaft, if the putter is moved out of position from the sight line, since there is a substantial distance between the point of attachment of the shaft and the centre of gravity of the putter head, which creates a momentum, i.e. a force of torque of the shaft if inaccurately positioned during the stroke.

Moreover, the preferred embodiment for attaching the head to the shaft does comprise a rod shaped part of substantial length, which rod shaped part is positioned substantially perpendicularly in relation to the hitting face of the putter head, so as to form said extended sight line. This special feature of the invention will give the player a similar feeling of accuracy as a pool (billiard) player since he will actually have the possibility to see a rod shaped part move along the sight line signalling a feeling of extra accuracy.

Since the horizontal, rod shaped part protrudes through the putter head, its end face is co-planar with the hitting face. The end face of the rod is positioned at the optimal point for hitting the ball. Thanks to this design the player will be able to actually sense, by means of vibrations in the shaft, when an accurate hit of the ball is performed.

Figure 2:
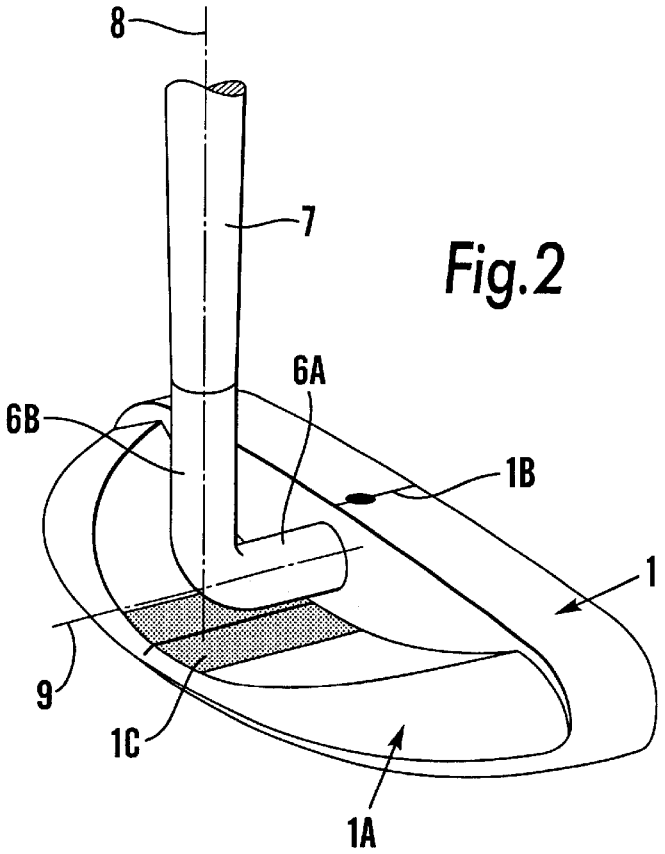
FIG. 2 is a perspective view of a preferred embodiment of the invention.

FIG. 2 shows a preferred embodiment of a golf putter according to the invention. A major difference in relation to FIG. 1 is that the putter head 1 is arranged with a rearwardly extending protrusion 1A at its lower portion. Also here, the extended sight line is achieved by having an L-shaped attachment device 2 which comprises one horisontally extending rod shaped part 6 A, which is attached substantially at the centre of the rearwardly facing part 1C of the head 1. The other rod shaped part 6B, the neck, does not extend exactly coaxially with said centre line 8 of said shaft 7, but forms a minor angle in order to achieve that it can be positioned with its imaginary centre line in the same plane as the player positions his eyes during the stroke. The imaginary centre line 9 of the horisontally extending rod shaped part 6A extends substantially perpendicular in relation to the hitting surface 3 of the putter head, to form said extended sight line for extra accuracy of the movement when hitting a golf ball with the putter head moving along a straight line. As shown, the sight line 1B is prolonged at the top of the head 1 by a blackened groove. Furthermore, a wide area 1C below the horisontal rod 6A is blackened in order to improve accuracy, which is achieved by the contrast it creates in relation to the metallic surface of the rod 6A.

Figure 3:
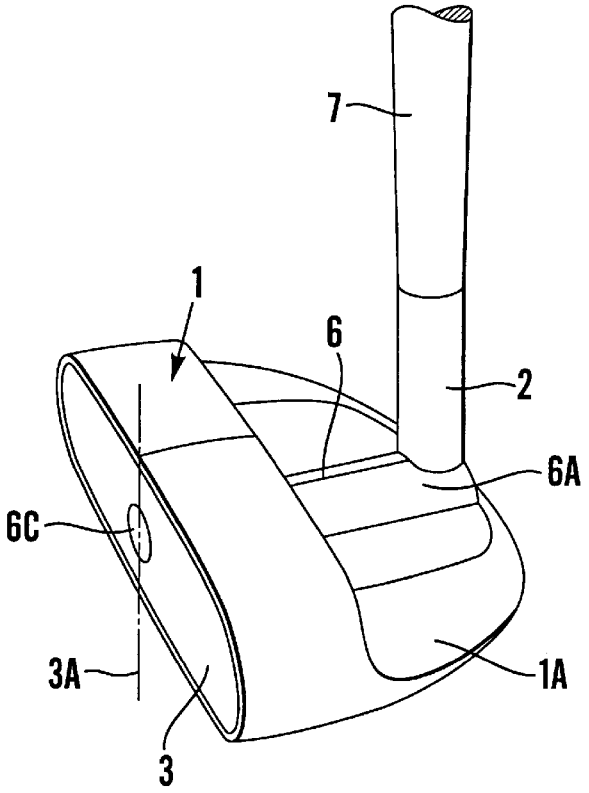
FIG. 3 is perspective view of a further embodiment according to the invention.

In FIG. 3 there is shown a modified embodiment of the invention. The design is basically the same as shown in FIG. 2 except for the rod shaped horizontal part 6A, which forms an integral part of said putter head 1. Accordingly the head is preferably produced as one single part, e.g. by casting, including the rod shaped horizontal part 6A. Preferably, the rod shaped part 6A is made of a different material then the rest of the putter head 1, in order to provide for the feeling of distinct feed back as described above. Accordingly, the front end 6C of such a rod shaped part 6A will form a part of the hitting surface 3. As can be seen in FIG. 3 the rod 6A is positioned such that its front end 6C is centred in relation to a vertical centre line 3A of the hitting surface 3. FIG. 3 shows the use of an attachment device 2, in the form of a neck portion between the shaft 7 and the head 1, but as is evident for the skilled man this attachment may be achieved by attaching the shaft directly to the head 1. Furthermore, FIG. 3 shows that further accuracy may be obtained by prolonging the sight line 1B to also run along the rod shaped part 6A, which of course also may be utilized in connection with the other embodiments.

The skilled man realises that the invention is not limited to the above shown embodiments, but that it may be varied within the scope of the claims. For instance instead of having the attachment point of the rod 6A near the midpoint of the head so that it is positioned within the same plane as the vector of the centre of gravity x, it may also be positioned somewhat off-centred if a player would desire to feel some torque during the stroke. Furthermore, it is evident that there exist many different obvious alternatives of attaching the shaft to the L-shaped attachment device as is also the case in relation to the attachment of the head. Moreover, it is evident that many other contrasting colours than metalic/black may be used in order to distinguish the rod from the putter head.

What is claimed is:

1. Putter, comprising a shaft (7), a putter head (1) with a hitting face (3) and means for attaching the putter head (1) to the shaft (7), said shaft (7) having an imaginary centre line (8) positioned substantially coaxially within said shaft, said putter head (1) having a centre of gravity (x), said means comprising an attachment device (2) having at least one rod shaped part (6A) with an imaginary centre line (9), said rod shaped part (6A) being attached to the putter head so as to have said centre line extending substantially perpendicularly in relation to the hitting surface (3) of the putter head, characterised in that said rod shaped part (6A) extends all the way through said putter head to form a part (6C) of the hitting surface (3), and that said part (6C) of the rod (6A) which forms a part of the hitting surface (3) is positioned within the hitting surface (3) in such a manner that the rod shaped part (6A) forms an extended sight line for extra accuracy of the movement when hitting a golf ball with the putter head (3).

2. Putter according to claim 1, characterised in that said part (6C) of the rod shaped part (6A) is positioned to intersect a vertical center line (3A) of the hitting surface, substantially centered in relation to said center line (3A).

3. Putter according to claim 1, characterised in that said attachment device (2) is L-shaped and that it comprises a further rod shaped part, a neck portion (6B), which extends substantially coaxially with said centre line (8) of said shaft (7).

4. Putter according to claim 1, characterised in that said putter head (1) is arranged with a rearwardly extending protrusion (1A), forming an integral part thereof, for attachment of the shaft (7) thereto.

5. Putter according to claim 4, characterised in that said rod shaped part (6A) has a contrasting colour in relation to the upwardly facing surface (1C) of the rearwardly extending protrusion (1A).

6. Putter according to claim 1, characterised in that there is arranged a sight line on top of the putter head (1, 1A) extending at least a portion between the point of attachment of the shaft (7) and the upper edge of the hitting surface (3).

7. Putter according to claim 1, characterised in that said imaginary centre line (8) of the shaft (7) and a normal of the hitting face (3) forms an angle ($\alpha$) which is less than 90° in a plane that is parallel to the centre line of the shaft (7) and perpendicular to the hitting face (3).

8. Putter according to claim 7, characterised in that the angle ($\alpha$) is such that the top end of the shaft is positioned substantially in the same plane as the hitting face (3).

9. Putter according to claim 1, characterised in that the putter head (1) is pivotally adjustably attached to said rod by means of a screw (11) which is tightened in a threaded bore (10) of the head (1).

10. Putter according to claim 1 characterised in that said imaginary centre line of the rod shaped part (6A) is positioned within a distance from the lowermost part of the putter head (1) that is between 15 and 25 mm, and in that the hitting face (3) has a plane that opens up about 2–5° ($\beta$) in relation to a vertical plane.

11. Putter according to claim 1, characterised in that the shaft (7) and the head (1) are attached to each other in such a manner that a the point of intersecting of said centre line (8) and a normal extending inwardly of said hitting faces (3) is positioned at a longer distance from said hitting face (3) than the centre of gravity (x), so as to form a minimum distance (L) between said centre line (8) and said centre of gravity (x).

12. Putter according to claim 11, characterised in that said minimum distance (L) exceeds 10 mm and is less than 100 mm.

13. Putter, comprising a shaft 8, a putter head 1 with a hitting face 3 and means for attaching the putter heard 1 to the shaft 7, said shaft 7 having an imaginary center line 8 positioned substantially coaxially within said shaft, said putter head 1 having a center of gravity (x) said means comprising an attachment device 2 having at least one rod-shaped part 6A with an imaginary center line 9, said rod-shaped part 6A being attached to the putter head so as to have said center line extending substantially perpendicularly in relation to the hitting surface 3 of the putter head, characterized in that said rod-shaped part 6A extends in such a manner than the rod-shaped part 6A forms an extended sight line for extra accuracy of the movement when hitting a golf ball with the putter head 3, that said putter head 1 is arranged with a rearwardly extending protrusion 1A and that said rod-shaped part 6A has a contrasting color in relation to the upwardly facing surface 1C of the rearwardly extending protrusion 1A, and characterized in that said putter head 1 is arranged with a rearwardly extending protrusion 1A, preferably forming an integral part thereof, for attachment of the shaft 7 thereto.

* * * * *